United States Patent [19]

Leismer et al.

[11] Patent Number: 4,838,355

[45] Date of Patent: Jun. 13, 1989

[54] DUAL HYDRAULIC SAFETY VALVE

[75] Inventors: Dwayne D. Leismer, Pearland; William A. Blizzard, Jr., Houston, both of Tex.

[73] Assignee: Camco, Incorporated, Houston, Tex.

[21] Appl. No.: 242,747

[22] Filed: Sep. 9, 1988

[51] Int. Cl.[4] ..... E21B 34/10; E21B 43/12

[52] U.S. Cl. ..... 166/375; 166/319; 166/332

[58] Field of Search ..... 166/375, 374, 319, 321, 166/332, 72

[56] References Cited

U.S. PATENT DOCUMENTS 2,798,561 7/1957 True ..... 166/321
3,799,258 3/1974 Tausch ..... 166/72
4,161,219 7/1979 Pringle ..... 166/324
4,187,876 2/1980 Lang ..... 166/319 X
4,624,315 11/1986 Dickson et al. ..... 166/375 X

*Primary Examiner*—Stephen J. Novosad
*Attorney, Agent, or Firm*—Fulbright & Jaworski

[57] ABSTRACT

A subsurface well safety valve having two control lines which run from the well surface to first and second piston and cylinder assemblies for controlling the valve. The first of the assemblies is connected to a flow tube for operating the valve but the second assembly is disconnected from the flow tube. When a failure occurs in the primary control system, the first assembly is disconnected from the flow tube and the second piston and cylinder assembly is connected to the flow tube to operate the safety valve.

16 Claims, 6 Drawing Sheets

DUAL HYDRAULIC SAFETY VALVE

BACKGROUND OF THE INVENTION

It is known, as disclosed in U.S. Pat. No. 4,161,219, to utilize a subsurface safety valve which is controlled from the well surface through a control line acting on a piston and cylinder assembly which controls a tubular member which in turn controls the movement of a valve closure member. The valve is normally biased to a closed position and is opened by applying hydraulic pressure in the control line. Such safety valves must be fail-safe, that is, they must fail in the closed position if any of the components in the valve fail. However, when the valve closes, due to an operating hydraulic control system failure, the well will become inoperative until workover or wireline operations occur. These may be time-consuming and expensive operations.

The present invention is directed to a dual hydraulic subsurface safety valve that utilizes two operating control systems. Therefore, if the primary operating control system fails, it can be disconnected and the secondary operating control system is utilized to continue the operation of the safety valve. However, the setting depth and operating pressures of the dual hydraulic valve do not vary from a standard single hydraulically actuated valve, and remains fail-safe.

SUMMARY

The present invention is directed to a subsurface well safety valve for controlling the fluid flow through a well conduit and includes a housing having a bore and a valve closure member moving between open and closed positions for controlling the fluid flow through the bore. A tubular member is telescopically movable in the housing for controlling the movement of the valve closure member. The present invention is directed to an improvement in fluid actuating means for actuating the valve closure member and includes a first piston and cylinder assembly in the housing adapted to be connected to a hydraulic control line and said first assembly is connected to the tubular member. A second piston and cylinder assembly is provided in the housing adapted to be connected to a hydraulic control line and the second assembly is disconnected from the tubular member. Means are provided for disconnecting the first assembly from the tubular member and connecting the second assembly to the tubular member. This allows the safety valve to be operated normally by the first piston and cylinder assembly, but in the event of a failure in the primary operating control system, the first assembly is disconnected from the tubular member and the second piston and cylinder assembly is to provide a redundant operating control system.

Still a further object of the present invention is wherein the first assembly is adapted to be connected to a separate and independent control line from the hydraulic control line to which the second assembly is adapted to be connected for isolating the faults in one control system from the other control system.

Yet a still further object of the present invention is the provision of a releasable stop means in the housing initially restraining the longitudinal movement of the second assembly in the housing when hydraulic pressure is applied to the second assembly prior to its connection to the tubular member.

Yet a further object of the present invention is wherein disconnecting the first assembly and connecting the second assembly includes means for rotating parts of the first and second assemblies. In one form of the invention a first gear means is connected to the first assembly, a second gear means connected to the second assembly and third gear means connected to the first and second gear means.

Still a further object is wherein the means for rotating parts of the first and second assemblies includes means biasing the third gear means, and releasable means initially preventing movement of the third gear means. Preferably, the releasable means includes a release piston in fluid communication with the second piston and cylinder assembly and the release piston is vented to the outside of the housing for reducing the differential pressure required to actuate the release piston.

Still a further object of the present invention is wherein the means for rotating parts of the first and second assembly includes a movable external sleeve on the housing for allowing testing of both the first and second piston and cylinder assemblies at the surface before running the valve.

Still a further object of the present invention is wherein spring-biasing means are connected to the tubular member for closing the valve and the first assembly is connected to the tubular member at a point spaced from the spring for preventing the first assembly from acting on the spring due to hydrostatic pressure when the first assembly is disconnected from the tubular member.

Yet a further object of the present invention is the provision of a method of operating a subsurface well safety valve having dual operating hydraulic control systems by disconnecting the first assembly from the tubular member and connecting the second hydraulic assembly to the tubular member to provide a redundant control. The method preferably includes closing the valve prior to disconnecting the first assembly and connecting the second assembly. The method further includes providing first and second hydraulic control lines in communication with the first and second piston assemblies, respectively, disconnecting the first assembly and connecting the second assembly by providing rotational movement between parts of the first and second assemblies relative to the tubular member, and actuating the rotational movement from the second hydraulic control line.

Other objects, features and advantages will be apparent from the following description of a presently preferred embodiment of the invention, given for the purpose of disclosure and taken in conjunction with the accompanying drawings.

DESCRIPTION OF THE PREFERRED EMBODIMENT

Figure 1:
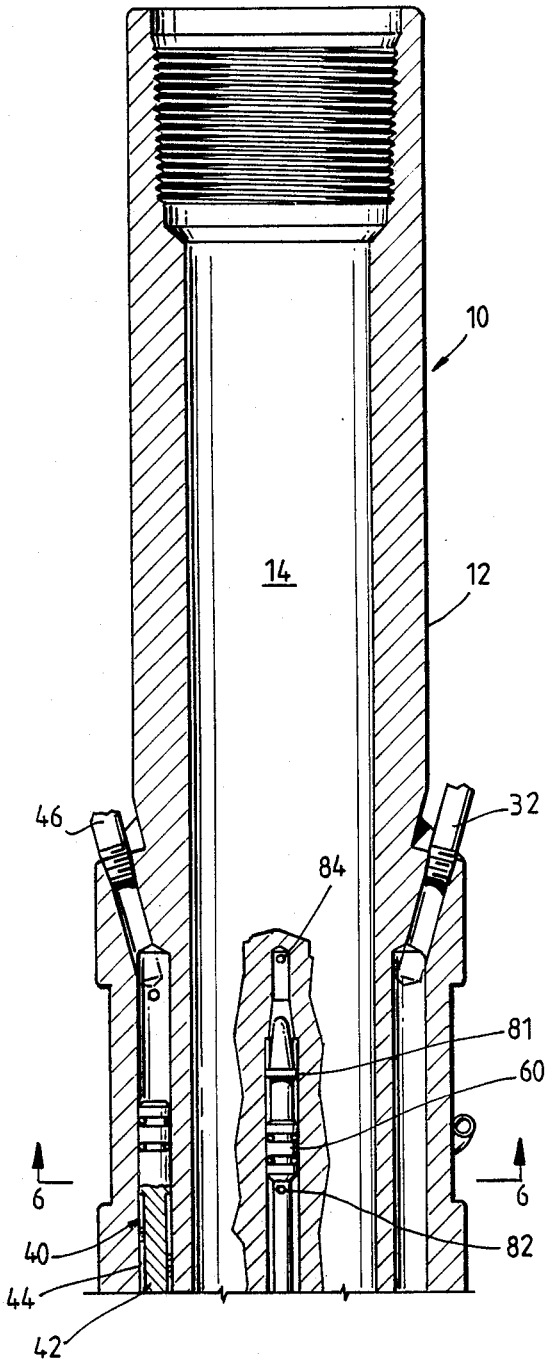
FIGS. 1 through 5 are continuations of each other and constitute an elevational view, in cross section, of a subsurface hydraulically controlled well safety valve utilizing the present invention.

While the present invention will be described in connection with a subsurface tubing safety valve having a flapper type valve closure member and illustrative connecting and disconnecting means, it is understood that the present invention may be used with other types of safety valves, other valve closure members, and other mechanisms for connecting and disconnecting the hydraulic piston and cylinder assemblies from the tubular member.

Referring now to the drawings, and particularly to FIGS. 1–5, the reference numeral 10 generally indicates a subsurface tubing safety valve of the present invention which includes a body or housing 12 which is adapted to be connected in a well tubing to permit well production therethrough under normal operating conditions, but in which the safety valve 10 may close or be closed in response to abnormal conditions.

The valve 10 includes a bore 14, an annular valve seat 16 (FIG. 5) positioned about the bore 14, a valve closure element such as a flapper valve element 18 connected to the body 12 by a pivot pin 20. Thus, when the flapper valve 18 is in the upward position and seated on the valve seat 16, the safety valve 10 is closed blocking flow upwardly through the bore 14 and well tubing.

Figure 5:
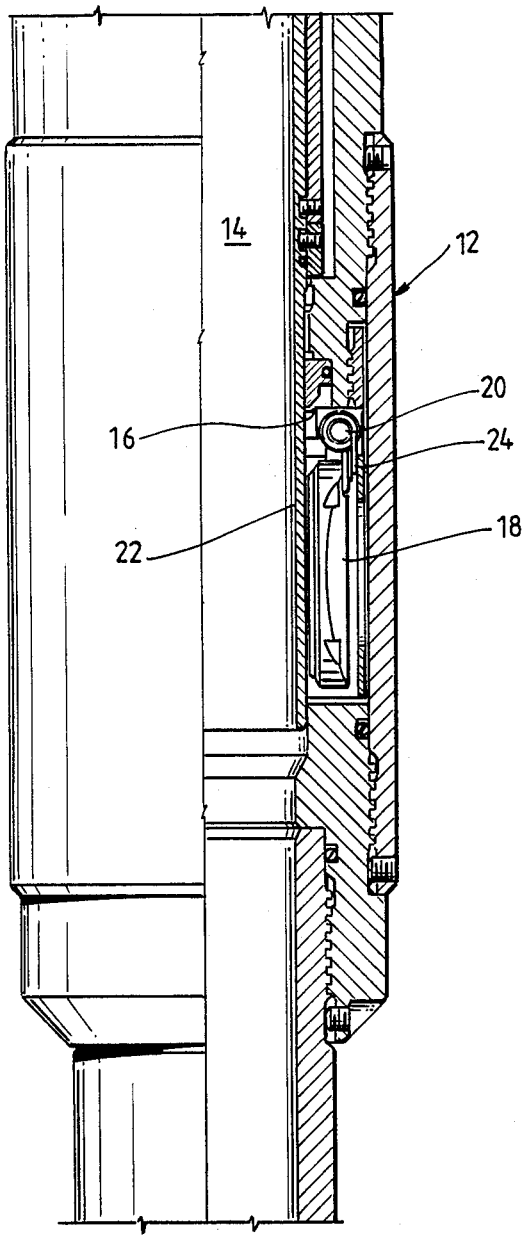

A flow tube or longitudinal tubular member 22 is telescopically movable in the body 12 and through the valve seat 16. As best seen in FIG. 5, when the tubular member 22 is moved to a downward position, the tube 22 pushes the flapper 18 away from the valve seat 16. Thus, the valve 10 is held in the open position so long as the tube 22 is in the downward position. When the tube is moved upwardly, the flapper 18 is allowed to move upwardly on to the seat 16 by the action of a spring 24, and also by the action of fluid flow moving upwardly through the bore 14.

The flow tube or tubular member 22 is biased in an upward direction by a suitable means which may include a spring 26 (FIGS. 3 and 4) for yieldably urging the member 22 in an upward direction to release the flapper 18 for closing the valve 10. The safety valve 10 is controlled by the application or removal of a pressurized fluid, such as hydraulic fluid, through a control path or line such as a control line 32 extending to the well surface or the casing annulus which supplies pressurized fluid to a first piston and cylinder assembly generally indicated by the reference numeral 34 which includes a piston 36 movable relative to a cylinder 38, one of which, here shown as the piston 36, is connected to the flow tube 22 by a connection which will be more fully described hereinafter. The safety valve 10 is controlled by the application or removal of pressurized hydraulic fluid through the control line 32 to supply and vent hydraulic operating fluid from the piston and cylinder assembly 34. When pressurized fluid is supplied to the assembly 34, the tubular member 22 moves downwardly to open the valve 10. When hydraulic pressure is vented from the line 32, the biasing means, including the spring 26, moves the tubular member 22 upwardly to allow the valve 10 to close.

The above description is generally disclosed in U.S. Pat. No. 4,161,219. However, various components in the operating control system could fail such as the seals on the piston 36, the connection of the control line 32 to the housing 12, the control line 32 itself can fail, or the well surface connection to the control line 32 may fail. In such an event, the valve closes and production from the well stops until workover or wireline intervention occurs such as by pulling the well conduit and replacing the safety valve 10 or running an additional wireline safety valve into the bore 14. Both of these remedies are time-consuming and expensive.

The present invention utilizes two operating hydraulic contol systems, one of which, such as the line 32 and first piston and cylinder assembly 34, is the primary operating control system which is used to normally operate the safety valve 10. However, a redundant secondary operating control hydraulic system is provided. In the event that a failure occurs in the primary operating control system, the primary operating control system is disconnected from the flow tube or tubular member 22 and the redundant or secondary operating control system is connected to the tubular member 22 and is thereafter used to operate the safety valve 10. By disconnecting the first hydraulic piston assembly 34 from the tubular member 22, and connecting a second hydraulic piston and cylinder assembly, which will be more fully described hereinafter to the tubular member 22, the following advantages are obtained:

1. The setting depth and operating pressures of the dual hydraulic valve does not vary from a standard single hydraulic valve and remains fail-safe;

2. The biasing force, such as the force of spring 26 necessary to close the valve 10, need only lift the hydrostatic head in one of the piston and cylinder assemblies, not both.

3. Preferably, by using two independent control lines the various possible failures in one operating system can be isolated from and not affect the second operating control system.

Figure 2:
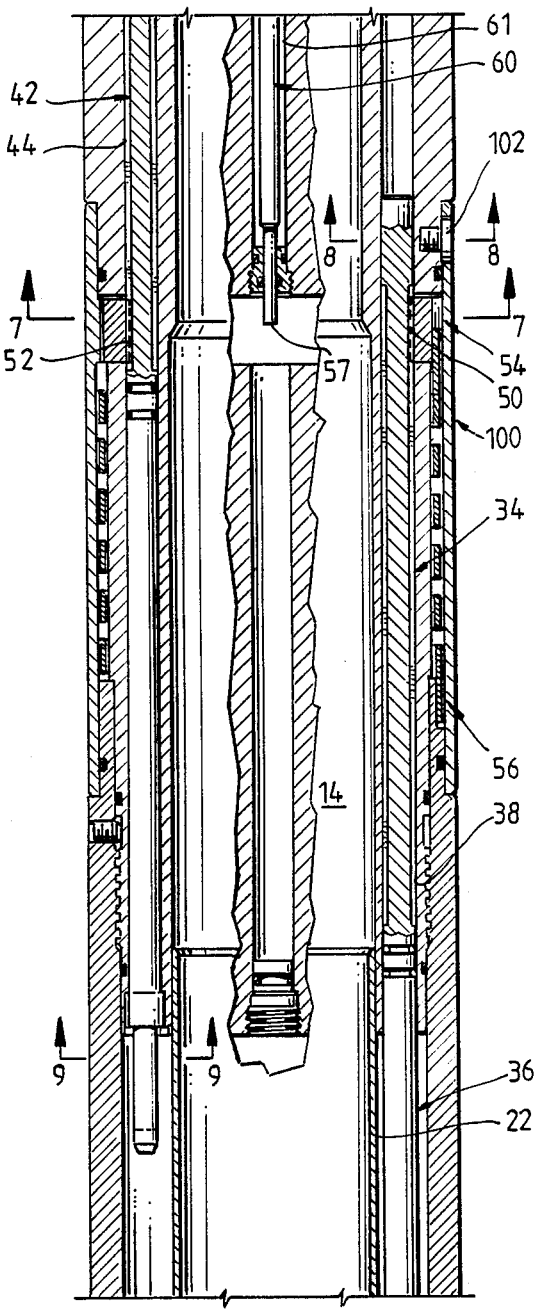

Referring now to FIGS. 1 and 2, a second piston and cylinder assembly, generally indicated by the reference numeral 40, is provided in the housing 12 and includes a second piston 42 movable in a cylinder 44. A secondary hydraulic control line 46, preferably independent from hydraulic control line 32 is provided in fluid communication with the second piston and cylinder assembly 40. Normally, the second piston and cylinder assembly 40 is not connected to the flow tube or tubular member 22. Instead, the valve 10 is operated from the hydraulic control line 32 acting upon the first piston and cylinder assembly 34. In the event of a failure in the primary operating hydraulic control system, means are provided for disconnecting the first piston and cylinder assembly 34 from the tubular member 22, connecting the second piston and cylinder assembly 42 to the tubular member 22 and thus operating the valve 10 from the redundant or secondary control system.

Figure 7:
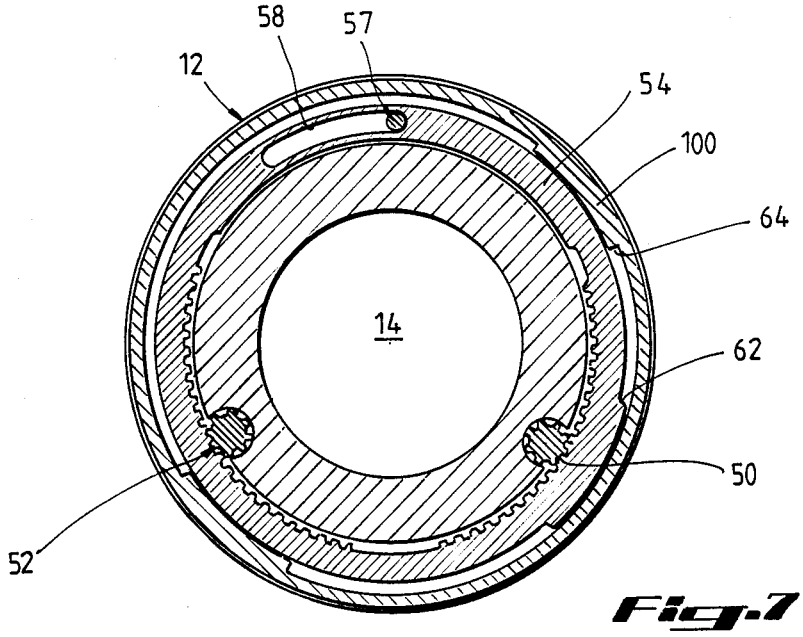
FIG. 7 is a cross-sectional view taken along the line 7—7 of FIG. 2.
Figure 8:
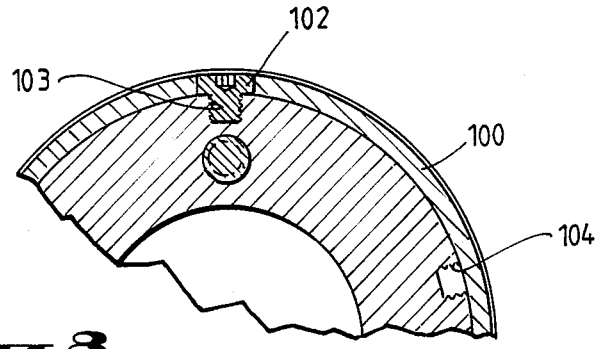
FIG. 8 is a fragmentary, cross-sectional view taken along the line 8—8 of FIG. 2.

Referring now to FIGS. 2 and 7, the means for disconnecting the first assembly 34 and connecting the second assembly 40 includes means for rotating parts of the first and second assemblies. While various mechanisms can be provided, as best seen, a first gear 50 is provided in the form of a spline along the first piston 36. A second gear 52 is provided in the form of a spline along the second piston 42. A third ring gear 54 is provided in the housing meshing with the first gear 50 and the second gear 52. The ring gear 52 is resiliently urged, as best seen, in a counterclockwise direction by a torque spring 56. Normally, the ring gear 54 is prevented from a rotative movement in the housing 12 by a pin 57 positioned in a slot 58 in the ring gear 54 and the pin 57 is connected to a torque piston 60 (FIGS. 1 and 2) in the position shown in FIGS. 2 and 7. The first piston and cylinder assembly 34 is connected to the tubular member 22 while the second piston and cylinder assembly 40 is disconnected from the tubular member 22 by means which are more fully described hereinafter. However, when the piston 60 is actuated, its shear pin 81 sheared, and the pin 57 removed, the torque spring 56 will rotate the ring gear 54 in a counterclockwise direction until a shoulder 62 on the ring gear engages a stop shoulder 64 on the housing. Rotation of the ring gear 54, for example 30°, will rotate the first gear 50 and the second gear 52 a predetermined amount, such as 180°, to disconnect the first assembly 34 from the tubular member 22 and connect the second piston and cylinder assembly 40 to the tubular member 22.

Figure 3:
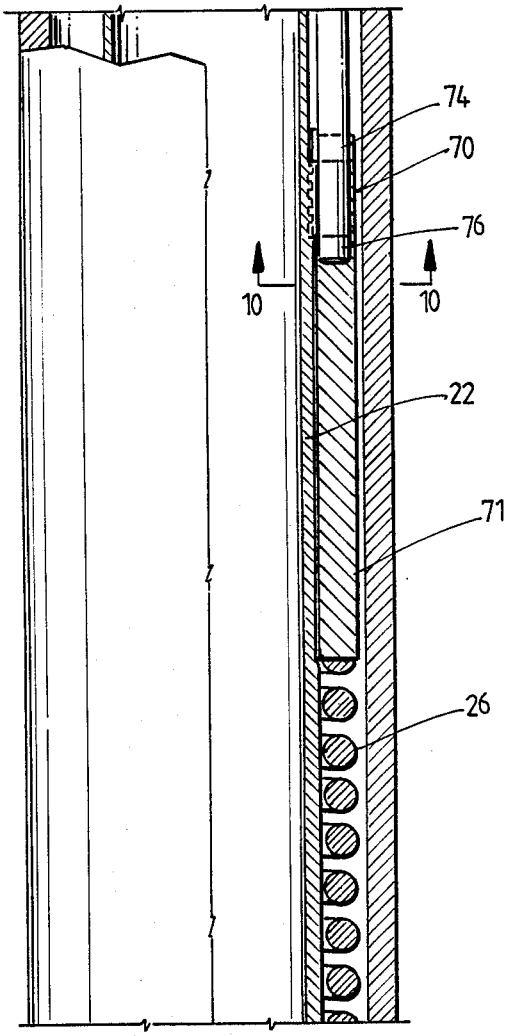
Figure 4:
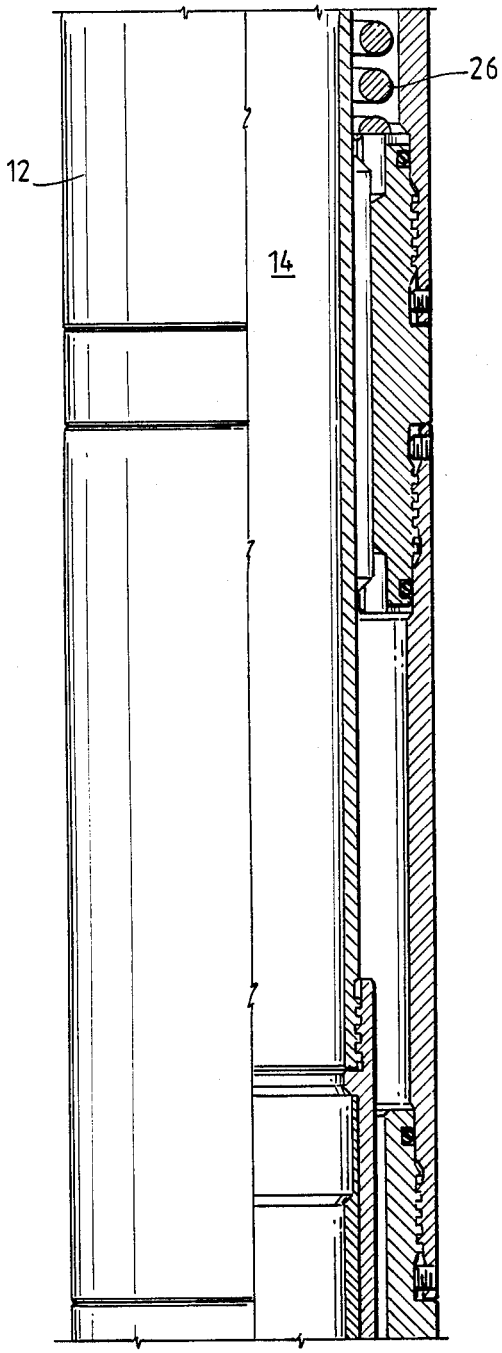
Figure 10:
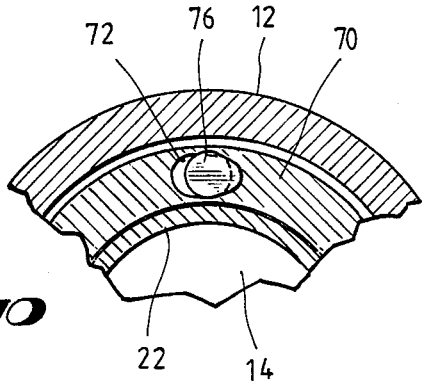
FIG. 10 is a fragmentary, cross-sectional view taken along the line 10—10 of FIG. 3.
Figure 11:
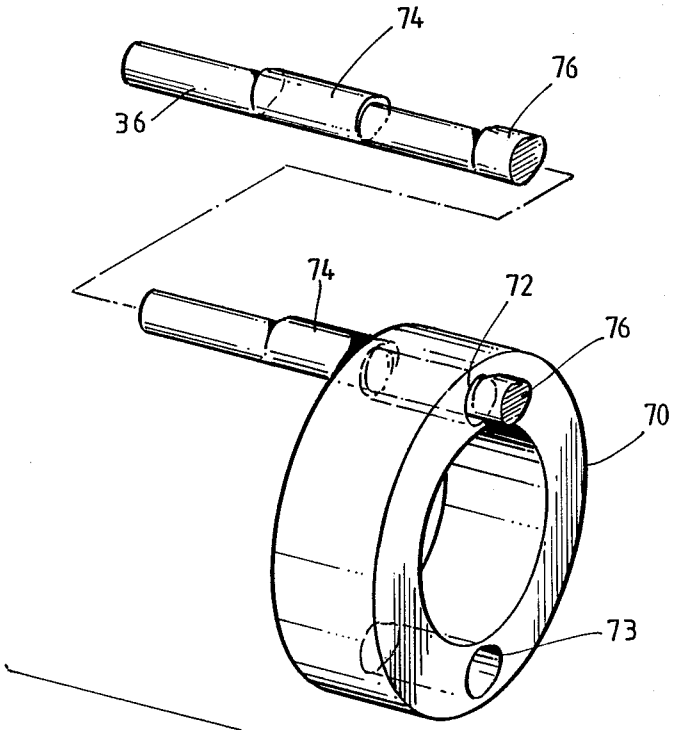
FIG. 11 is an enlarged isometric view of the means for connecting the first piston and cylinder assembly to the the tubular member.

Referring now to FIGS. 3, 10 and 11, one form of means for providing a positive connect-disconnect mechanism between the first piston and cylinder assembly 34 and the tubular member 22 is best seen. A ring 70 is provided in the housing 12 and connected to the exterior of the tubular member 22 and includes a first opening 72 and a second opening 73 therethrough. The piston 36 of the first piston and cylinder assembly 34 includes a first cam 74 and a second cam 76. With the end of the piston 36 longitudinally inserted through the opening 72 in the ring 70 and rotated into an off center position as best seen in FIGS. 10 and 11, the first piston 36 is locked to the tubular member 22. However, when the piston 36 is rotated 180° by the ring gear 54, the cams 74 and 76 are aligned with the opening 72 in the ring 70, and thus are disconnected from the ring and thus from the tubular member 22.

It is to be noted from FIG. 3 that the connection of the piston 36 to the ring 70 is at a point spaced from the upper end of the biasing spring 26. A hollow member 71 is provided to receive the disconnected piston 36 without the piston 36 being in contact with the spring 26. Therefore, spring is not required to bias against the hydrostatic head acting on the top of the disconnected piston 36.

Figure 6:
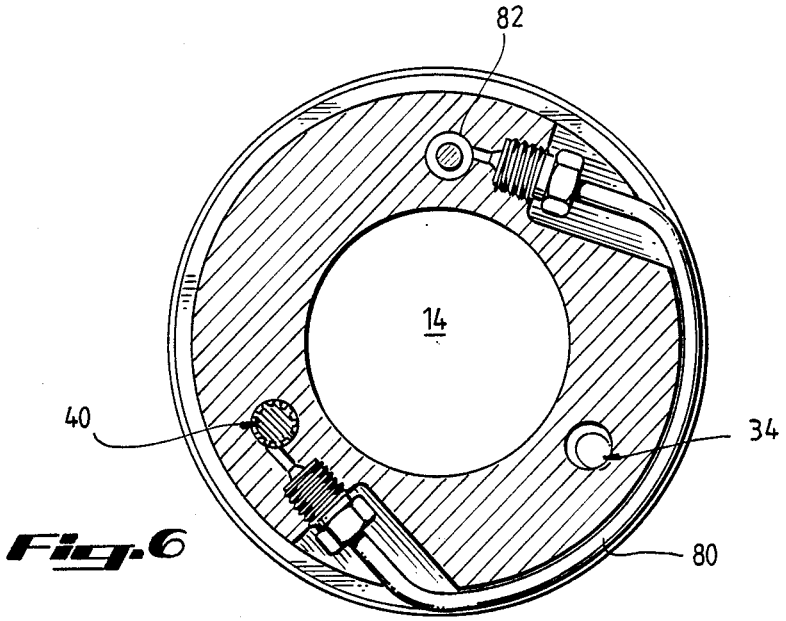
FIG. 6 is a cross-sectional view taken along the line 6—6 of FIG. 1.

Referring now to FIGS. 1 and 6, the hydraulic control line 32 is connected to the first piston and cylinder assembly 34 for actuating or venting the first assembly 34. The second control line 46 is connected to the second piston and cylinder assembly 40 for pressurizing and venting the second assembly 40. As shown, a hydraulic connection 80 is provided between the second assembly 40 and to the cylinder 61 at a point 82 below the torque piston 60. Therefore, by applying pressure through the secondary control line 46 to the second assembly 40, pressure is applied to the underside of the torque piston 60 to release the pin 57 (FIG. 7) to allow actuation of the ring gear 54 and disconnection of the first assembly 34 and connection of the second assembly 40. It is to be noted from FIG. 1 that a vent 84 is provided on the second side of the piston 60 by being vented to the exterior of the housing 12, the differential pressure required to actuate the torque piston 60 is minimized. While the control line 32 could be connected to both assemblies 34 and 40, and the line 46 used to actuate the piston 60, the present independent control lines 32 and 46 isolate faults in one control system from the other control system.

Figure 9:
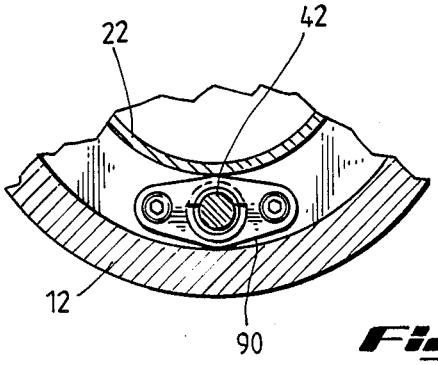
FIG. 9 is a fragmentary, cross-sectional view taken along the line 9—9 of FIG. 2.
Figure 12:
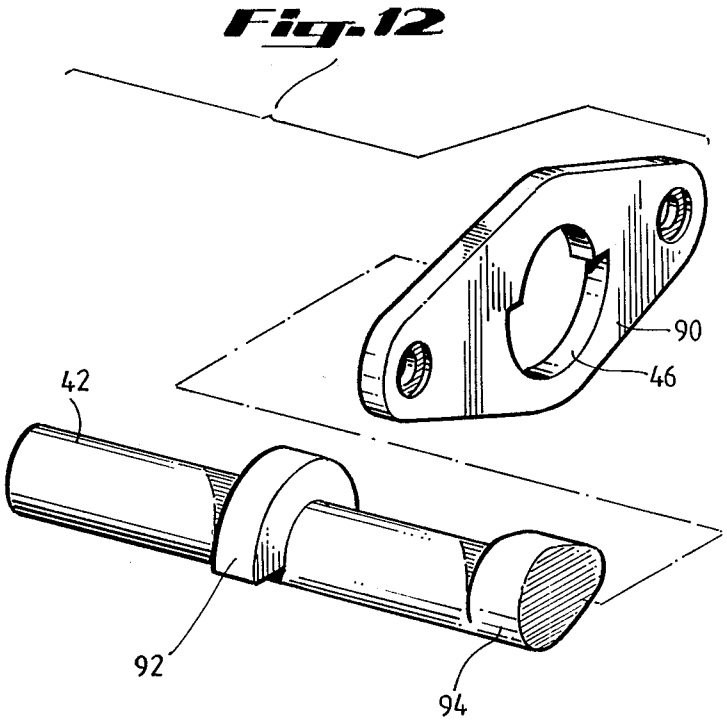
FIG. 12 is an enlarged isometric view of the connection on second piston and cylinder assembly and releasable stop means.

The means for connecting and disconnecting the second piston and cylinder assembly 42 from the tubular member 22 may be the same as for the first piston and cylinder assembly 34, as best seen in FIG. 11. However, since the hydraulic fluid from the secondary control line 46 is used to actuate the torque piston 60 for disconnecting and connecting the assemblies 34 and 40, respectively, the secondary piston and cylinder assembly 40 is restrained from longitudinal movement by a stop 90 (FIGS. 2, 9 and 12) prior to connection of the second piston 42 to the ring 70. The second piston 42 includes a first 92 and second 94 spaced cams thereon. Initially, the cam 92 is out of registry with an opening 96 in the stop cover 90 thereby preventing longitudinal movement of the piston 42 until rotated by gear 54. Prior to actuating the connect-disconnect mechanism, the safety valve 10 is closed allowing the ring 70 (FIG. 11) to move upwardly between the cams 92 and 94 and against the stop 90 allowing the lower cam 94 to pass through the opening 73 in the ring 70. Upon pressuring up to the secondary line 46, the ring gear 54 is rotated to rotate the second piston 42 180° thereby releasing the cam 92 to pass through the opening 96 in the stop 90 and simultaneously to fasten and connect the piston 42 to the ring 70 which is connected to the flow tube 22.

The present valve also has the capability of testing the operation of both the first assembly 34 and the second assembly 40 at the well surface before running the valve 10. First, by applying pressure to the operating control line 32, the first piston and cylinder assembly 34 can be tested. After the operating pressure is bled from the line 32, a sleeve 100 on the housing 12 is disconnected from the housing 12 by unscrewing a pin 102 from hole 103, rotating the sleeve 100 until its shoulders 64 contact the shoulders 62 on the ring gear 54. Subsequent rotation tightens the torque spring 56 and rotates the pistons 36 and 42 180° thereby disconnecting piston 36 and connecting piston 42 to the tubular member 22. The pin 102 is positioned in hole 104 to hold its test position. To assure that the secondary pressure applied to the control line 46 does not shear the pin 81, the annular vent 84 is manifolded to the secondary control line 46. Pressure can then be applied to the secondary control line 46 and the operating control system containing the second piston and cylinder assembly 40 can be tested. Once tested, the retaining screw pin 102 is removed from hole 104, the sleeve 100 is rotated to its original position and pin 102 is reinserted into hole 103.

In operation, the safety valve 10 is operated as a normal single piston safety valve by using the hydraulic control line 32 to actuate the first piston and cylinder assembly 34 to operate the valve as needed while the second control line 46 is vented during normal or primary operation. When a failure occurs in the operation of the primary control system, the valve is moved to a closed position allowing the connecting ring 70 (FIGS. 3 and 11) to move upwardly to be positioned between the cams 92 and 94 on the second piston 42 (FIG. 12) by venting the primary control line 32. The secondary control line 46 is then pressured up to actuate the torque piston 60 releasing the ring gear 54 to actuate the disconnect and connect mechanisms of FIGS. 11 and 12, thereby releasing the first piston and cylinder assembly 34 from the tubular member 22 and connecting the second piston and cylinder assembly 42 to the tubular member 22. The advantages of using two independent operating control systems is that (1) failures in one of the systems will not adversely affect the other system, (2) the setting depth and operating pressures of the dual hydraulic valve 10 remains the same as for a standard single piston valve, (3) the valve remains fail-safe, and (4) the spring force necessary to close the valve is required to lift only the hydrostatic head of the piston which is in the operating position, and not both.

The method of operating the subsurface well safety valve is apparent from the foregoing description of the structure and operation. The method includes operating a suburface well safety valve having a tubular member telescopically movable in a housing for controlling the movement of a valve member in which a first piston and cylinder assembly in the housing is connected to the tubular member and a second piston and cylinder assembly in the housing is disconnected from the tubular member. The method is directed to disconnecting the first assembly from the tubular member and connecting the second assembly to the tubular member. The method of operation also includes closing the valve prior to disconnecting the first assembly and connecting the second assembly. The method includes providing first and second separate hydraulic control lines in communication with the first and second piston and cylinder assemblies, respectively, disconnecting the first assembly and connecting the second assembly by providing rotational movement between parts of the first and second assemblies relative to the tubular member, and actuating the rotational movement from the hydraulic control line connected to the second assembly.

The present invention, therefore, is well adapted to carry out the objects and attain the ends and advantages mentioned as well as others inherent therein. While a presently preferred embodiment of the invention has been given for the purpose of disclosure, numerous changes in the details of construction and arrangement of parts, and steps of the process will readily suggest themselves to those skilled in the art and which are encompassed within the sprit of the invention and the scope of the appended claims.

What is claimed is:

1. In a subsurface well safety valve for controlling the fluid flow through a well conduit and including a housing having a bore and a valve closure member moving between open and closed positions for controlling the fluid flow through the bore, a tubular member telescopically moving in the housing for controlling the movement of the valve closure member, the improvement in fluid actuating means for actuating the valve closure member comprising, a first piston and cylinder assembly in the housing adapted to be connected to a hydraulic control line, said first assembly connected to the tubular member, a second piston and cylinder assembly in the housing adapted to be connected to a hydraulic control line, said second assembly disconnected from the tubular member, and means for disconnecting the first assembly from the tubular member and connecting the second assembly to the tubular member.

2. The apparatus of claim 1 wherein the first assembly is adapted to be connected to a separate hydraulic control line from the hydraulic control line to which the second assembly is adapted to be connected.

3. The apparatus of claim 1 including, releasable stop means in the housing initially restraining the longitudinal movement of the second assembly in the housing.

4. The apparatus of claim 1 wherein said means for disconnecting the first assembly and connecting the second assembly includes means for rotating parts of said first and second assemblies.

5. The apparatus of claim 4 including, first gear means connected to said first assembly, second gear means connected to said second assembly, third gear means connected to said first and second gear means.

6. The apparatus of claim 5 including, means biasing said third gear means, and releasable means initially preventing movement of the third gear means.

7. The apparatus of claim 6 wherein said releasable means includes, a release piston in fluid communication with the second piston and cylinder assembly.

8. The apparatus of claim 4 wherein the means for rotating parts of the first and second assembly includes a movable external sleeve on the housing for allowing testing of both assemblies.

9. The apparatus of claim 7 wherein the release piston is vented to the exterior of the housing on the side opposite its communication with the second assembly.

10. The apparatus of claim 1 including spring biasing means connected to the tubular member, and said first assembly connected to the tubular member at a point spaced from the spring for preventing the first assembly from acting on the spring when the first assembly is disconnected from the tubular member.

11. The method of operating a subsurface well safety valve for controlling the fluid flow through a well conduit in which the valve includes a housing having a bore and a valve closure member moving between open and closed positions for controlling the fluid flow through the bore, a tubular member telescopically moving in the housing for controlling the movement of the valve closure member, means biasing the tubular member to a closed position, a first piston and cylinder assembly in the housing connected to the tubular member and connected to a hydraulic control line, and a second piston and cylinder assembly in the housing disconnected from the tubular member and connected to a hydraulic control line comprising, disconnecting the first assembly from the tubular member, and connecting the second assembly to the tubular member.

12. The method of claim 11 including, closing said valve prior to disconnecting the first assembly and connecting the second assembly.

13. The method of claim 11 including, providing first and second separate hydraulic control lines in communication with the first and second piston and cylinder assemblies, respectively.

14. The method of claim 11 including, releasably restraining the longitudinal movement of the second assembly in the housing until the second assembly is connected to the tubular member.

15. The method of claim 11 including, disconnecting the first assembly and connecting the second assembly by providing rotational movement between parts of said first and second assemblies relative to the tubular member.

16. The method of claim 11 including, providing first and second separate hydraulic control lines in communication with the first and second piston and cylinder assemblies, respectively, disconnecting the first assembly and connecting the second assembly by providing rotational movement between parts of said first and second assemblies relative to the tubular member, and actuating said rotational movement from the hydraulic control line connected to the second assembly.

* * * * *